United States Patent [19]

Nichols

[11] 4,383,663

[45] May 17, 1983

[54] ACTIVE OPTICAL TERMINAL HOMING

[75] Inventor: Roy L. Nichols, Ridgecrest, Calif.

[73] Assignee: The United States of America as represented by the Secretary of the Navy, Washington, D.C.

[21] Appl. No.: 690,207

[22] Filed: Jun. 1, 1976

[51] Int. Cl.[3] ..... F41G 7/22

[52] U.S. Cl. ..... 244/3.16

[58] Field of Search ..... 244/3.16

[56] References Cited

U.S. PATENT DOCUMENTS

| | | | |
|---|---|---|---|
| 3,943,277 | 3/1976 | Everly et al. | 178/6.8 |
| 3,951,358 | 4/1976 | De Lano et al. | 244/3.16 |
| 3,954,228 | 5/1976 | Davis, Jr. | 244/3.16 |

*Primary Examiner*—Charles T. Jordan

*Attorney, Agent, or Firm*—R. F. Beers; W. Thom Skeer

[57] ABSTRACT

An active optical terminal homing system for providing target-centroid tracking when integrated with conventional passive, semi-active and active air target seeker systems. The system combines an active optical scanning laser (ultra-violet thru far infrared) radar tracker with the apertures of passive, semi-active and active midcourse guidance assemblies in a missile.

7 Claims, 8 Drawing Figures

$$\vec{V} = \frac{1}{n} \sum_{i=1}^{n} \vec{v}_i$$

n = NUMBER OF PULSES IN ONE CONICAL SCAN
$\vec{V}_i$ = INDIVIDUAL VECTIONAL POSITION IN SIGNAL AMPLITUDE AND CONICAL SCAN ANGLE
V = VECTIONAL SCAN OF RETURN SIGNAL TO GIVE STEERING DIRECTION AND MISSILE THRUST MAGNITUDE

ACTIVE OPTICAL TERMINAL HOMING

BACKGROUND OF THE INVENTION

The basic terminal homing problem with conventional seekers is that they do not reliably home on the target centroid. All radar systems suffer from poor end-game performance because of poor antenna beam resolution, the inability to resolve target centroid location from the target backscatter signal and countermeasures susceptibility. Passive optical seekers are generally more accurate than radar seekers in clear air tactical environments. However, the typical passive seeker systems track the infra-red radiation of the target exhaust and guide on a point located in the plume, or at best, the hot tail pipe.

The magnitude of the passive seeker problem with respect to miss distance is illustrated in FIG. 1. For tail and head-on target encounters with passive optical homing missiles, plume tracking may yield high hit probabilities, but in the event of broad side or beam encounters, target hit probabilities are greatly reduced since the guidance homing point is on the plume or tail pipe of the target aircraft. Currently, passive seeker studies are under way to reduce the broad side miss distance distribution. The typical techniques involved are edge bias and lead bias concepts. Theoretically, edge bias will cause the seeker to track the tail pipe and lead bias can then be used to cause the missile-target contact point to occur at some predetermined distance in front of the passively tracked tail pipe.

PRIOR ART

The conventional methods for providing terminal homing for air target systems are active and semi-active radar and passive optical. The radar systems suffer from poor end-game performance because of poor antenna beam resolution, inability to determine the target centroid from the target backscatter signal and counter measures susceptibility. Passive optical seeker systems track the infrared radiation of the target exhaust and guide on a point in the plume or at best the tail pipe of the target aircraft and are very susceptible to flare-type counter measures; consequently they also fall short of guiding on the target centroid.

All of the aforementioned seeker systems fall short of tracking the target centroid during intercept and more often miss than hit their targets. There is an operational need for a centroid-tracking terminal-homing system to alleviate this particular deficiency.

SUMMARY OF THE INVENTION

The active optical terminal homing (AOTH) subsystem has the capability of providing the needed end-game centroid tracking when used either alone or when integrated with conventional passive, semi-active and active seeker subsystems. The subsystem comprises an active-imaging system using, for instance, a gallium arsenide (GaAs), yttrium aluminum garnet (YAG), carbon dioxide ($CO_2$) and Helium Neon (HeN) laser radar technique.

Figure 1:
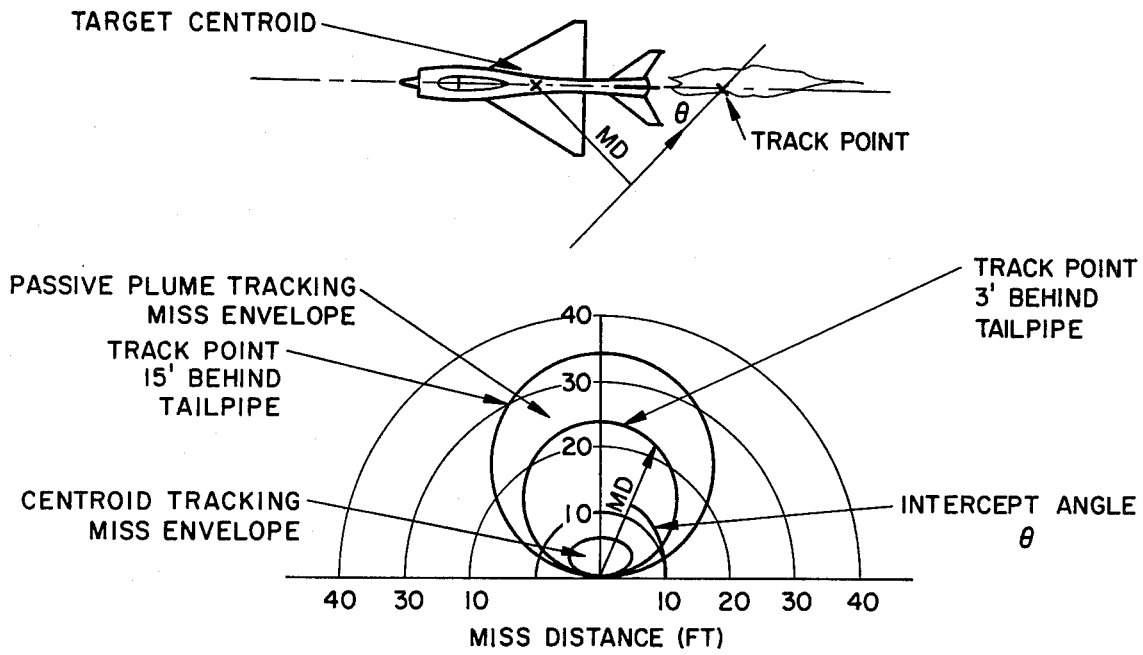
FIG. 1 is a diagram illustrating passive seeker miss distance versus guidance track point.
Figure 2:
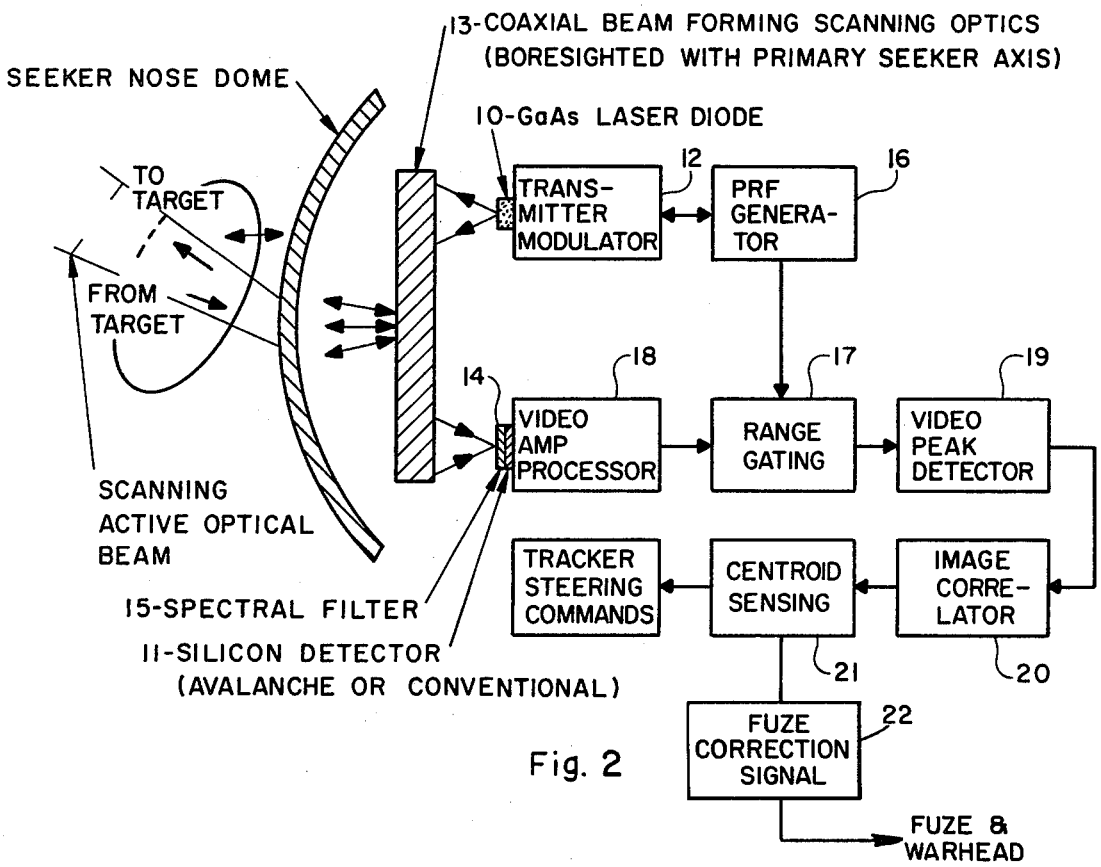
FIG. 2 is a block diagram of a preferred embodiment of the active optical terminal homing guidance system.

A block diagram of the preferred embodiment is set forth in FIG. 1 and consists of a pulsed GaAs injection laser diode 10 operating at 0.9 microns as a transmitter, a silicon photodiode 11 as the sensitive detector element, a transmitter modulator 12 for supplying high current pulses and receiving and target signal image processing circuitry in an overall pulsed optical radar configuration.

Optics 13 are used to form a coaxial-scanning pencil beam, direct the transmitted infrared radiation onto the target and concentrate the received target backscatter return onto the photodiode receiver surface after passing through a spectral filter 15. A prf generator 16 outputs a signal to the transmitter modulator 12 and another signal to range gating circuitry 17.

Figure 3:
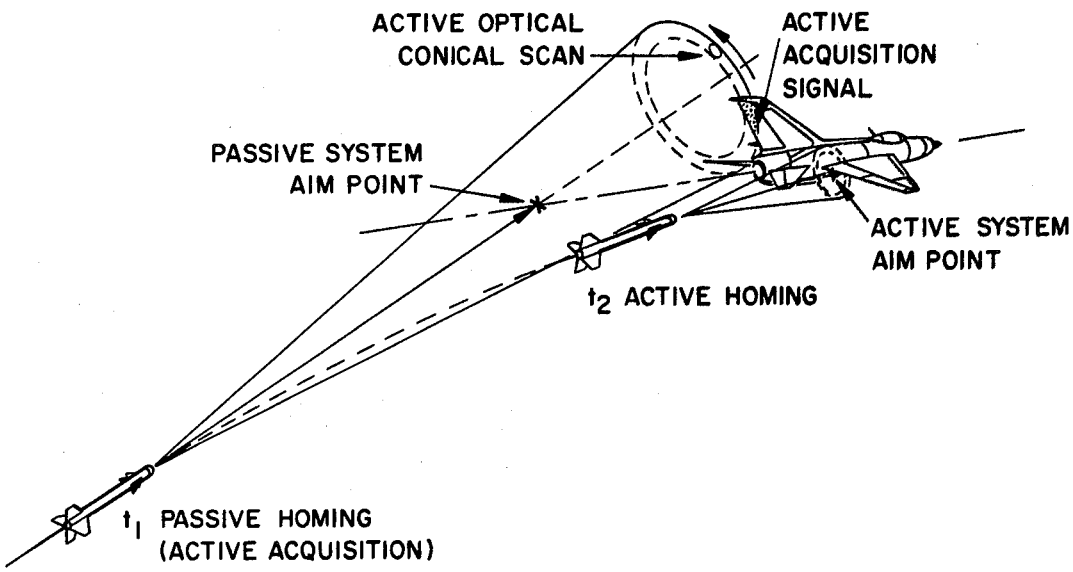
FIG. 3 illustrates typical operation of the active optical terminal homing guidance system.
Figure 4:
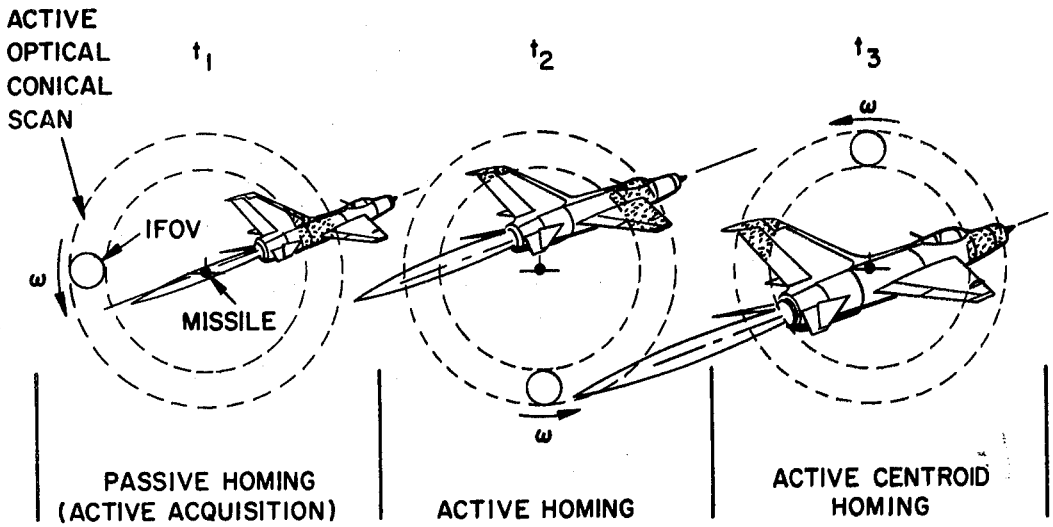
FIG. 4 is an illustration of a missile-based view of the active optical terminal homing guidance system.

The output of the silicon detector 11 is coupled to a video amplifier processor 18 which outputs a signal to the range gating circuitry 17. The range gating circuitry 17 outputs a signal to a video peak-detector 19 which in turn is coupled to the input of an image correlator 20. The output of the image correlator 20 is coupled to the input of a centroid sensing network 21 which in turn outputs steering command signals to the missile fins. The centroid tracker operates to aim the missile seeker at the centroid of the target. This is illustrated in FIGS. 3 and 4 wherein the aim point of the missile is steered to the centroid of the target. This is done by determining where the scan is intercepting the target with respect to the axis of scan and thereafter steering the missile so that the scan intercepts the target as nearly equally as possible in all four quadrants of the 360° scan.

In operation, the system functions as a pulse radar sending out radiation in the form of short invisible IR light pulses. The pulsed laser radiation from the system strikes the target aircraft and the reflected energy is collected by the receiver collecting aperture. The target echo signals are passed to video processing and range gating circuits 18 and 17 respectively that are sensitive to only those target echo signals which are of sufficient strength within the range gate.

The pulse repetition frequency (prf) generator 16 provides a clock signal to trigger the current pulse from the transmitter modulator 12 to the GaAs laser 10 and opens up the range gate interval to the receiver in the range gating circuitry 17. The target pulses from the range gating circuitry 17 are peak detected in the video peak-detector 19 to provide a signal proportional to the target return at all positions in the scanning image field.

Probability theory is applied to the peak detected target signal to insure maximum responsiveness to valid target signals while minimizing susceptibility to spurious background signals.

The peak-detected signal is then processed in an image correlator 20 that determines from the vectorial sum of the scan target return signals the position of the target return signals during the conical scan. The image correlator signals are then further processed by calculating the direction and magnitude of the vectorial sum of the distributed signals during the conical scan in the centroid sensing circuit 21 to determine the logical position of the target centroid and the flight direction correction. In this manner, error signals from the centroid sensor 21 provide the tracker steering. Another output from the centroid sensing circuit is coupled to a fuze correct circuit 22.

The active centroid tracking and error steering signal is shown in more detail in FIGS. *7a* and *7b*. The instantaneous active optical FOV is shown sweeping out a conical scan pattern. As this conical pattern is rotated, the active source is transmitting pulses of IR energy. Therefore, in a complete scan, n pulses are transmitted.

In both FIGS. *7a* and *7b*, some of the transmitted pulses strike the target (shown as x points on the aircraft). For each of the transmitted IR signals that strikes the target, a reflected signal is returned to the dual-mode seeker active receiver. The magnitude of each of the returned signals is measured as well as its position angle in the conical scan. This provides an individual vector signal ($\overline{V}$) for each return. All returns are then vectorially summed to create a composite vector guidance signal ($\overline{V}$) for steering the dual mode seeker (mounted in a missile) to the apparant active return centroid.

The uniqueness of the active optical terminal homing subsystem lies in the formation of a partial image of those portions of the target illuminated by the laser radar. The active optical conical scan technique described herein is a pseudo-target imager (see FIGS. 3 and 4). As shown, the active optical pencil beam FOV scans in a conical pattern across the target and produces active returns from those areas of the target where the beam intercepts the target (cross-hatched areas in FIGS. 3 and 4). For those portions of the target which are swiped by the active source beam, a pseudo-active image is obtained.

The optics of the active optical seeker are boresighted to the primary seeker axis which is directed at the target aircraft during midcourse guidance. The primary guidance could be passive, active, or semi-active optical or radar. Coaxial optics are used to insure that the transmit and receive fields of view interogate the same space during the scan.

Two-dimensional scanning can be achieved in several ways, e.g., mechanical raster scanning, electronically scanned array and conical scanning. The mechanical raster scanning can be achieved by rotating optical mirrors or wedges. In the electronically scanned array, both the GaAs diode source and the silicon photodiode would be mosaic arrays. The scanning would be achieved by simultaneous electronic scanning of each detector and source element in the array over the entire system field-of-view. The conical scanning can be accomplished by a tilted optical surface that would image only an annular field of view.

Three dimensional imaging could be attained by providing the active optical terminal homing subsystem with a discrete range gate. This feature would be valuable in discriminating between background and target signals. Besides the ability of the AOTH subsystem to track the apparent centroid of the target returns, the vectorial sum of the target return signals is used to determine the evolving magnitude, direction and time of the point of closest approach to the target. Therefore, the signals from the centroid sensing circuit 21 are processed by the proximity fuze correction circuit 22 to provide continuous fuze update information on the magnitude, direction and time of the point of nearest approach to the target. The fuze adjust signal can also be useful in determining the warhead activation velocity vector for an aimable warhead.

Typical operation of the AOTH subsystem is shown in FIGS. 3 and 4. In this example, the active homing has been integrated with a passive IR plume seeking guidance seeker as a dual mode passive/active terminal homing missile. The long range (midcourse) guidance is accomplished in the passive IR seeker mode which tracks the aircraft plume and heads for a near miss with the target. At $t_1$ in FIG. 4, the AOTH subsystem with a conical scan aquires the target and the homing mode switches from passive IR to active optical. When the AOTH senses (acquires) a series of target return signals, it automatically takes over control of the missile from the passive IR mid-course guidance. Therefore, it is the acquisition of active target returns that causes, automatically, the hand-off to the AOTH control guidance. The AOTH provides target centroid tracking and the missile would then impact the target.

Because of the shorter range capability, the AOTH mode of the seeker would be used only during the terminal phase of the encounter with acquisition ranges of 3,000 feet or more possible. Acquisition ranges up to 1,500 feet are adequate to allow the necessary missile trajectory corrections to be made.

The passive mode of the seeker would be used for the preliminary tracking at all times and for terminal tracking when head- or tail-on encounters are obtained. For broadside or near-broadside encounters, the guidance of the missile would be corrected by inputs from the active mode of the seeker. Using the passive/active (dual mode) seeker, a guidance system is provided that results in high hit probabilities for missile-target encounters from all encounter aspects.

The primary advantages of employing AOTH are: centroid tracking on the target airframe; increased target hit probability; range and range rate data acquisition for guidance and fuzing functions; high spatial resolution; enhanced countermeasures immunity; and small size.

Figure 5:
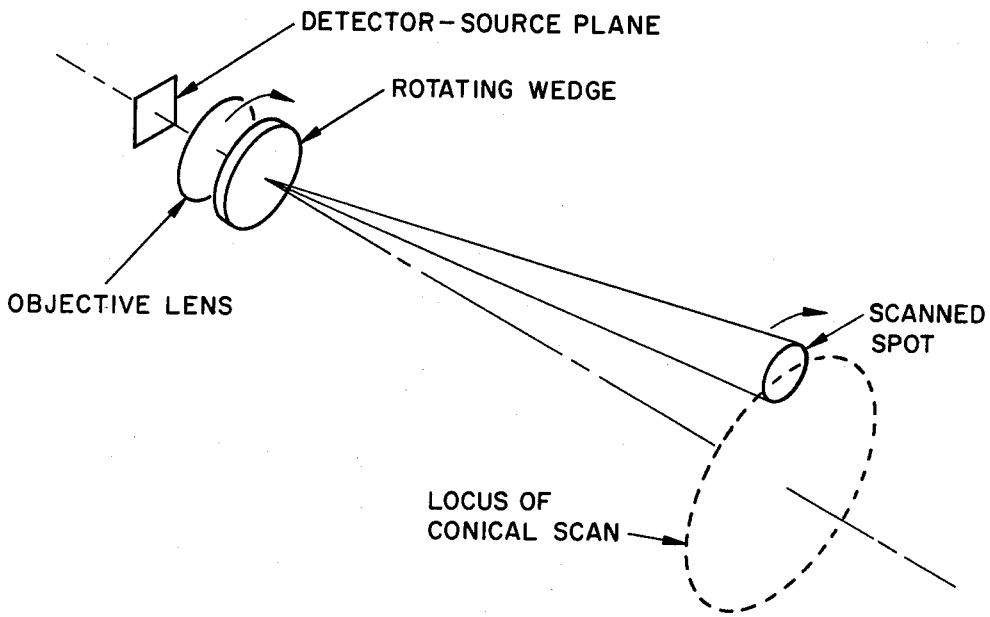
FIG. 5 illustrates a conical scan technique suitable for use in the AOTH.

A brief description of a conical scan technique which may be utilized in the AOTH is set forth in FIG. 5. The term conical scan refers to a scan which consists of a small instantaneous field of view which is rotated in a circle about the optical axis of the system. A conical scanner as set forth in FIGS. 5 and 6 consists of a detector (dual-mode passive and active seeker detectors in same plane) and source which are optically coincident coaxially, an objective lens and some method of generating the conical scan such as a rotating glass wedge in front of the objective lens. A rotating tilted mirror could also be used to generate the conical scan.

Advantages of the conical scanner include; a longer range capability, rapid scanning, and mechanical and electronic simplicity. However, the primary attribute of the conical scan is its compatibility with present passive seeker scanning techniques. Most passive infrared seekers employ a conical scan system. Therefore, a dual-mode passive/active seeker is set forth that uses the same conical scanning optics for both the passive and active optical channels.

Conical scanning is also an effective scan for seeker operations because it makes one scan of the field with a minimum number of active source pulses. Assuming a broadside terminal trajectory, there will be a range at which the target falls within the active conical scan and from this point on the missile can be guided to the target airframe by the active system as set forth in FIGS. 3 and 4.

Figure 6:
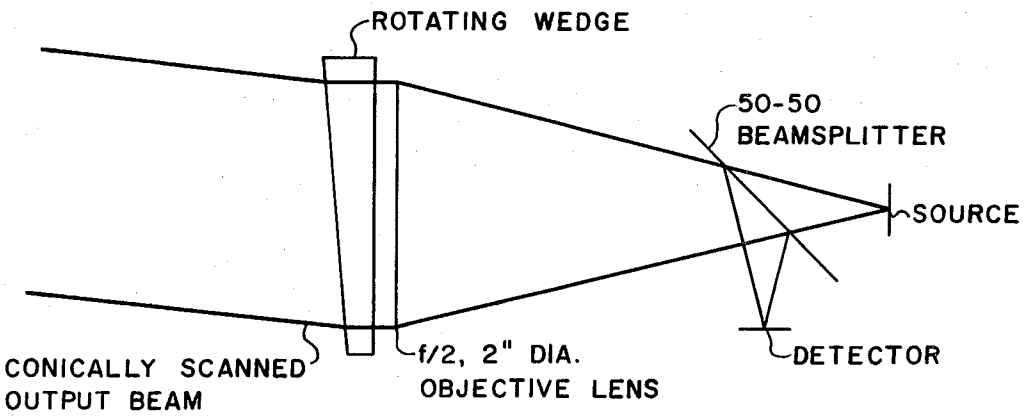
FIG. 6 illustrates conical scanning for the AOTH using an optical wedge; and FIGS. *7a* and *7b* show the active centroid tracking and error steering signal in greater detail.
Figure 7B:
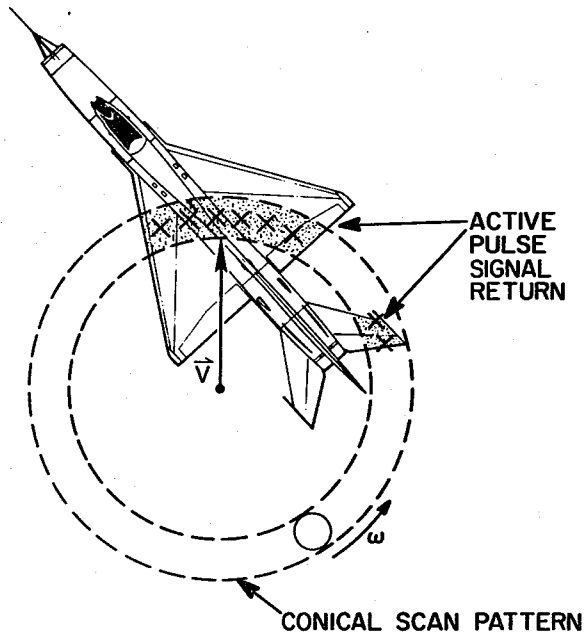
Figure 7A:
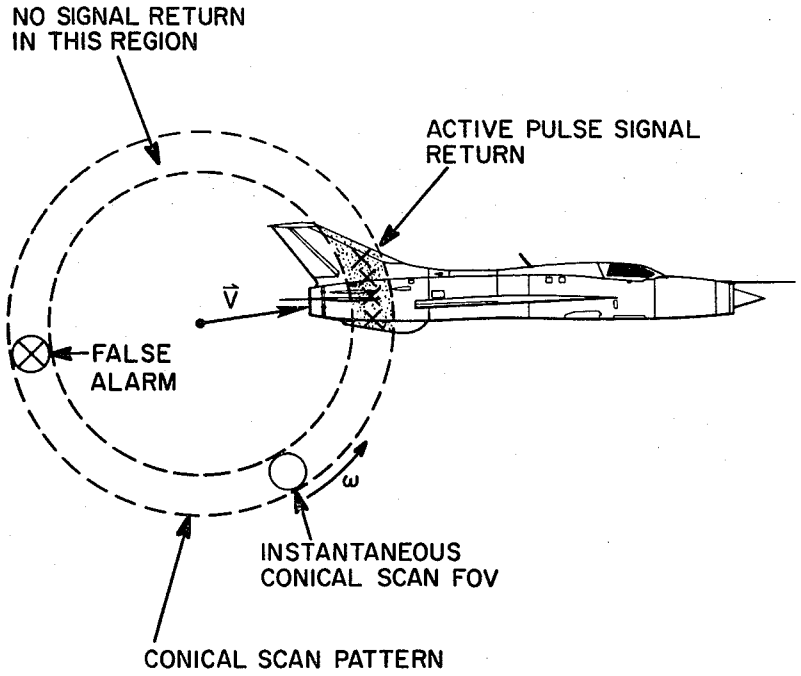

FIG. 6 shows the rotating optical wedge scanner which has been previously discussed. Excluding the optical wedge, the optics consist of an objective lens and a source and detector (passive and active in same plane) which are optically coincident (coaxial) in the focal plane of the objective lens. The beamwidth of the transmitted beam is controlled by the focal length of the objective lens and the diameter of the laser source. Likewise, the field of view of the system is controlled by the focal length of the objective lens and the diameter of the detection element. Placing an optical wedge in front of the objective lens bends all of the transmitted and received optical rays through the same angle. Thus, when the wedge is rotated, the output beam of the system rotates about the optical axis at a fixed angle to the axis, resulting in a conical scan.

Again, although the system has been described using a GaAs laser, it is to be understood that any suitable source could be used, such as a YAG, $CO_2$ or HeN laser.

I claim:

1. A dual mode coaxial passive/active homing missile guidance system incorporating a long range passive conical scan seeker which tracks an aircraft plume and an automatic hand-off to a boresighted coaxial active optical terminal homing guidance mode when an active optical subsystem acquires active returns from a target to accomplish centroid tracking of a target wherein said active optical subsystem comprises:

transmitter means for outputting a optical source of radiation;

beam forming scanning optics boresighted with said primary missile seeker in line with said optical source of radiation;

receiver means adapted to receive radiation reflected from a target which has been illuminated by said transmitted radiation;

range gating means operatively coupled to said receiver means;

timing means operatively outputting a signal to said transmitter means and said range gating means to effectively cause said range gating means to pass received radiation corresponding to a particular region in space;

centroid sensing means operatively coupled to the output of said range gating means for determining the centroid of said target;

wherein said centroid sensor means outputs signals corresponding to missile steering signals which are used to cause the missile to be steered to the centroid of the target;

said active optical terminal homing system being operative to acquire and track the target during the terminal phase of an encounter with the target.

2. A system as set forth in claim 1 wherein;

said transmitter means incorporates a laser for outputting an optical source of laser radiation.

3. A system as set forth in claim 1 wherein said timing means comprises a prf generator.

4. A system as set forth in claim 3 and further including;

a spectral filter between said coaxial beam forming scanning optics and said receiver means.

5. A system as set forth in claim 4 and further including;

a sensitive detector element sensitive to optical radiation in line with said spectral filter and between said spectral filter and said receiver means.

6. A coaxial active optical terminal homing subsystem for use in conjunction with a primary passive midcourse missile seeker to guide said missile to the vectorial sum of the active optical target return signals from a target comprising;

transmitter means for outputting an optical source of radiation;

a spectrally matched optical receiver detector for receiving active optical returns from a target illuminated by said source of radiation;

a coaxial beam forming scanning optics boresighted with said primary passive midcourse seeker in line with said optical source and said spectrally matched receiver detector;

range gating means coupled to said receiver detector for gating out out of range returns inputted to said detector and having an output;

pseudo-image correlator means operatively coupled to the output of said processing means for electronically processing and storing the vectorial magnitude and conical scan angle of each target return during a conical scan and having an output;

centroid sensor means receiving the output of said correlator means for processing the individual vectors of target return signals and determining the vectorial sum of said signals to provide the apparant centroid of the returns for missile centroid steering commands;

said active optical terminal homing subsystem being operative to acquire and track during the terminal phase of an encounter with a target;

said active optical terminal homing subsystem being further integrated coaxially with the apparatus of the passive midcourse guidance system.

7. A coaxial active optical terminal homing subsystem as set forth in claim 6 and further including;

a matched spectral filter between said coaxial beam forming scanning optics and said receiver detector.

* * * * *